US005219159A

United States Patent [19]

Malachowski et al.

[11] Patent Number: 5,219,159

[45] Date of Patent: Jun. 15, 1993

[54] TRANSLATING NIP REGISTRATION DEVICE

[75] Inventors: Michael A. Malachowski, Webster; Jacob N. Kluger, Rochester, both of N.Y.

[73] Assignee: Xerox Corporation, Stamford, Conn.

[21] Appl. No.: 891,106

[22] Filed: Jun. 1, 1992

[51] Int. Cl.[5] ..... B65H 7/02

[52] U.S. Cl. ..... 271/228; 271/236; 271/242; 271/252

[58] Field of Search ..... 271/228, 227, 236, 242, 271/252, 253, 255

[56] References Cited

U.S. PATENT DOCUMENTS

| | | | |
|---|---|---|---|
| 4,453,659 | 6/1984 | Torpey | 226/20 |
| 4,480,825 | 11/1984 | Landa | 271/81 |
| 4,500,045 | 2/1985 | Whitaker et al. | 242/57.1 |
| 4,685,664 | 8/1987 | Petersdorf | 271/227 |
| 4,805,892 | 2/1989 | Calhoun | 271/225 |
| 5,094,442 | 3/1992 | Kamprath et al. | 271/227 |

FOREIGN PATENT DOCUMENTS

| | | | |
|---|---|---|---|
| 181741 | 3/1989 | Japan | 271/228 |
| 2198952 | 8/1990 | Japan | 271/228 |

*Primary Examiner*—David H. Bollinger
*Attorney, Agent, or Firm*—Kevin R. Kepner

[57] ABSTRACT

An apparatus to bilaterally register and deskew sheets in an electrophotographic printing machine by driving the sheet against a pair of stalled drive rolls and then activating the drive rolls when the sheet is deskewed. The drive rolls are then laterally translated while the sheet is within the nips of the drive rolls. The proper side registration position of the sheet is sensed and stored and the sheet is brought to that proper registration position. Once the sheet has passed through the drive rolls, the rolls return to the center of the paper path to receive subsequent sheets. A stepper motor is used to translate the roll pairs in a lateral direction and the pulse counts are utilized to store the side registration and sheet acquisition positions thereby eliminating the need for a home position sensor or switch.

23 Claims, 4 Drawing Sheets

TRANSLATING NIP REGISTRATION DEVICE

This invention relates generally to a sheet registration system, and more particularly concerns a laterally translating nip registration device for use in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charge photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, paper handling devices have incorporated some sort of registration system to properly align sheets of paper passing through these devices. Whether the sheet is a document in a recirculating document handler or a copy sheet in the reproduction processor, registration or alignment of the sheets traveling through a paper path to a known orientation is necessary for the achievement of high quality copying. With particular reference to the reproduction processor, it will be appreciated that registration of copy sheets must include, for example, synchronization of the copy sheet edges with the latent image on the photoreceptor, as well as speed matching with the photoreceptor and transportation of the sheet into the transfer zone or deskewing of improperly fed copy sheets.

In a typical lateral registration device, drive rolls are laterally shifted while a sheet is in the nips of the rolls to bring the sheet to a registration point. Typically, the lateral registration devices operate either unidirectionally, being able to register a sheet that is misaligned in only one direction, or if a bilateral or two-directional corrective registration is allowed, the roll set must commonly trigger a center position or "home" sensor between each sheet. Other typical lateral registration devices involve the handling of web material in which the lateral position of a roll is continuously adjusted based upon feedback of a web edge sensor. The following disclosures may be relevant to various aspects of the present invention:

U.S. Pat. No. 5,094,442; Patentee—Kamprath, et ano. Issue Date—Mar. 10, 1992

U.S. Pat. No. 4,805,892; Patentee—Calhoun; Issue Date—Feb. 21, 1989

U.S. Pat. No. 4,685,664; Patentee—Petersdorf; Issue Date—Aug. 11, 1987

U.S. Pat. No. 4,480,825; Patentee—Landa; Issue Date—Nov. 6, 1984

U.S. Pat. No. 4,500,045; Patentee—Whitaker, et al.; Issue Date—Feb. 19, 1985

U.S. Pat. No. 4,453,659; Patentee—Torpey; Issue Date—Jun. 12, 1984

UK-Appl. No.-9119488.6; Applicant—Xerox Corporation; Date Filed—Sep. 11, 1991

The relevant portions of the foregoing disclosures may be briefly summarized as follows:

U.S. Pat. No. 5,094,442 discloses a bidirectional lateral registration device utilizing dual edge sensors and further having differentially driven drive rolls for deskewing purposes.

U.S. Pat. No. 4,805,892 discloses a unidirectional lateral registration device whereby a downstream pair of rollers is actually movable to bring an in-track edge of a sheet to a predetermined sensed position to register the sheet. A loop or buckle between the downstream and upstream drive rollers allows the lateral adjustment. After each sheet, the laterally adjusting roll mechanism must return to a home position triggering a sensor before receiving the next sheet.

U.S. Pat. No. 4,685,664 describes a sheet conveying device whereby a roll pair is laterally adjustable based on feedback from a paper path sensor for the conveyance of a paper web. The continuous edge of the web is monitored by sensors and based on the position of the web edge, a corresponding lateral adjustment is made by the adjusting roller.

U.S. Pat. No. 4,480,825 describes a method to offset a sheet on an output of a printing or copying device. Sheets belonging to alternate sets are offset by shifting a second set of rollers laterally following the emergence of the trailing edges from the first set of rollers. The emergence of the trailing edge is sensed by driving the second set of rollers at a slightly greater linear speed and sensing the retarding torque transmitted through the sheet from the first set of rollers.

U.S. Pat. No. 4,500,045 discloses a conveying system for a web member which utilizes a dual sensor arrangement to sense the position of the web edge which sensor feedback is utilized by a comparator to drive a stepper motor in the proper direction for lateral web edge alignment.

U.S. Pat. No. 4,453,659 describes a laterally adjustable roller assembly which again utilizes an edge sensor for the edge of web position and accordingly adjusts a laterally movable web exit guide roller. This lateral adjustment is accomplished by either a motor or cylinder for the axial displacement of the web exit guide roller.

UK-Appl. No.-9119488.6 describes a bilateral registration device which utilizes a home sensor to align the registration rolls between successive sheets to be registered.

In accordance with one aspect of the present invention, there is provided an apparatus for advancing a sheet in a primary sheet feeding direction and for deskewing and side registering a sheet. The apparatus comprises means, located in a home position, for advancing the sheet in the primary sheet feeding direction and deskewing the sheet. Means are also provided for sensing the sheet, the advancing means moving in unison with the deskewed sheet in a direction substantially transverse to the primary sheet feeding direction from the home position from a side registration position, the sensing means detecting the sheet in the side registration position.

Pursuant to another aspect of the present invention, there is provided an electrophotographic printing machine of the type in which a sheet is advanced in a primary sheet feeding direction and is deskewed and side registered. The improvement comprises means, located in a home position, for advancing the sheet in the primary sheet feeding direction and deskewing the sheet. Means are also provided for sensing the sheet, the advancing means moving in unison with the deskewed sheet in a direction substantially transverse to the primary sheet feeding direction from the home position from a side registratoon position, the sensing means detecting the sheet in the side registration position.

Still further pursuant to another aspect of the invention, there is provided a method for deskewing and side registering a sheet in an electrophotographic printing machine. The method comprises the steps of initializing a stalled roll pair a known distance from the a side registration edge of a primary paper path, then driving a sheet against the stalled roll pair to deskew the sheet. Next, simultaneously translating the roll pair in a direction transverse to the primary paper path while driving the sheet along the primary paper path by the roll pair and sensing the side edge of the sheet when it reaches the proper side registration position. The sensed proper side registration position is stored and the sheet is returned to the proper side registration position. Finally, the roll pair is returned to the initialized position in the primary paper path.

Other features of the present invention will become apparent as the following description proceeds and upon reference to the drawings, in which:

FIGS. 1A, 1B, and 1C are plan views of the present invention showing the relationship between the sheet sensor and the translating drive rolls during an exemplary registration cycle of the present invention;

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
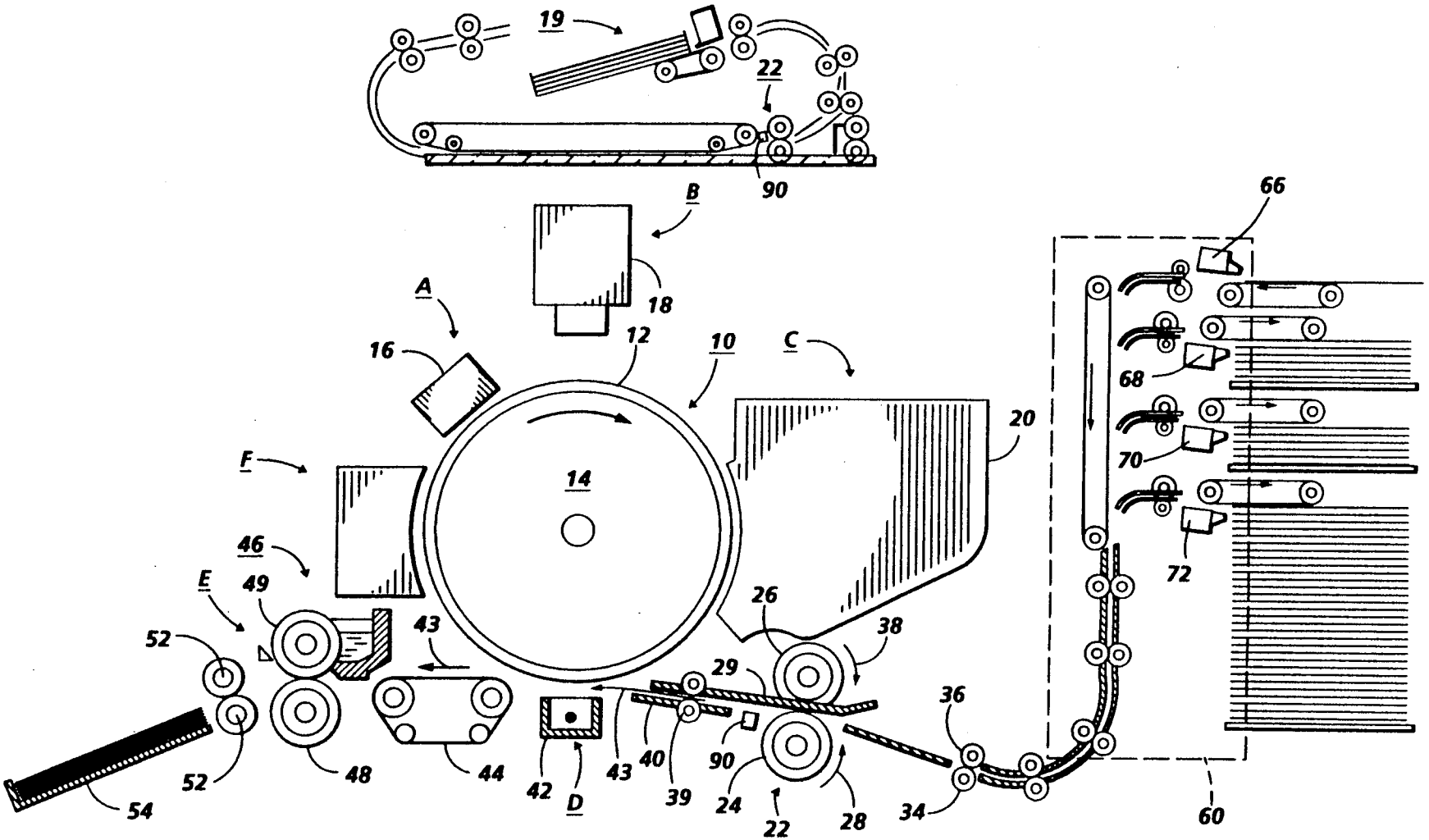
FIG. 4 is a schematic elevational view depicting an illustrative electrophotographic printing machine incorporating the sheet deskewing and registering apparatus of the present invention therein.

For a general understanding of an electrophotographic printing machine in which the features of the present invention may be incorporated, reference is made to FIG. 4 which depicts schematically the various components thereof. Hereinafter, like reference numerals will be employed throughout to designate identical elements. Although the apparatus for deskewing and registering sheets is particularly well adapted for use in the electrophotographic printing machine of FIG. 4, it should become evident from the following discussion that it is equally well suited for use in a wide variety of machines and is not necessarily limited in this application to the particular embodiment shown herein.

Since the practice of electrophotographic printing is well known in the art, the various processing stations for producing a copy of an original document are represented in FIG. 4 schematically. Each processing station will be briefly described hereinafter.

As in all electrophotographic printing machines of the type illustrated, a drum 10 having a photoconductive surface 12 secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. A series of original documents can be fed to the platen by a document handler, generally referred to by reference numeral 19. Lamps illuminate the original document. Scanning of the original document is achieved by oscillating a mirror in a timed relationship with the movemmt of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be facilitated by a printing apparatus utilizing electrical imaging signals. The printing apparatus can be a digital copier including an input device such as a raster input scanner (RIS) and an output device such as a raster output scanner (ROS), or, a printer utilizing an output device such as a ROS.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 4, a copy sheet is advanced by sheet feeding apparatus 60 along the paper path which includes drive rolls 34 and 36 to the deskewing and registration apparatus of the present invention, generally indicated by reference numeral 22, which includes drive roller 24 and idler roller 26. Drive roller 24 is driven by a motor (not shown) in the direction of arrow 28 and idler roller 26 rotates in the direction of arrow 38 since roller 26 is in contact therewith. In operation, feed device 60 operates to advance the copy sheet from the selected tray through the guide and path along which rolls 34 and 36 are located and then into registration roller pairs 24, 26 and 25, 27 (FIG. 2) such that the sheet is forwarded to drum 12 in synchronism with the developed image on the drum. The sheet is advanced in the direction of arrow 43 to roll pair 39 and through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to the copy sheet. After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 49 and a backup roll 48 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIGS. 1A–3 depict the structure and operation of the deskewing and lateral registration apparatus in greater detail.

Figure 1A:
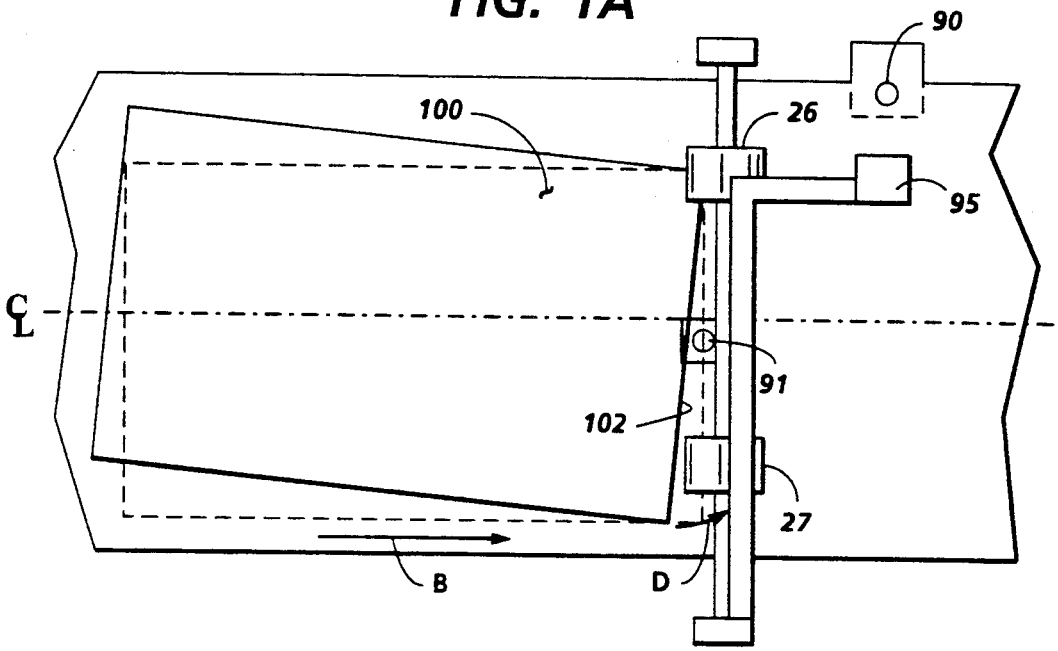

Turning now to FIGS. 1A, 1B, 1C and 2, there is shown a schematic representation of the present invention during an exemplary registration cycle. With reference to FIG. 1A, it can be seen as the sheet 100 is fed by drive rolls (not shown) toward the registration roll set 24, 26, 25 and 27, which has been initialized at the approximate centerline of the paper path as is discussed below, the leading edge of the sheet 102 initially contacts one side of the registration rolls, in this case it is shown contacting roll pair 27 and 25, which rolls are initially in a stopped position. The sheet 100 continues to be driven forward by drive rolls in the direction of arrow B which causes the sheet 100 to rotate in the direction of arrow D until the leading edge 102 is aligned in both registration roll pairs 25 and 27 and 24 and 26, thereby deskewing the sheet 100. An acquisition sensor 91 detects when the sheet 100 contacts the registration roll pairs 25, 27 and 24, 26. A timer delays the start of the stalled registration rolls 25, 27 and 24, 26 for a predetermined period which will allow the sheet 100 to be deskewed. The registration roll pairs 24, 26 and 25, 27 are then driven so that the sheet 100 is entirely within the nips of the rolls.

Figure 1B:
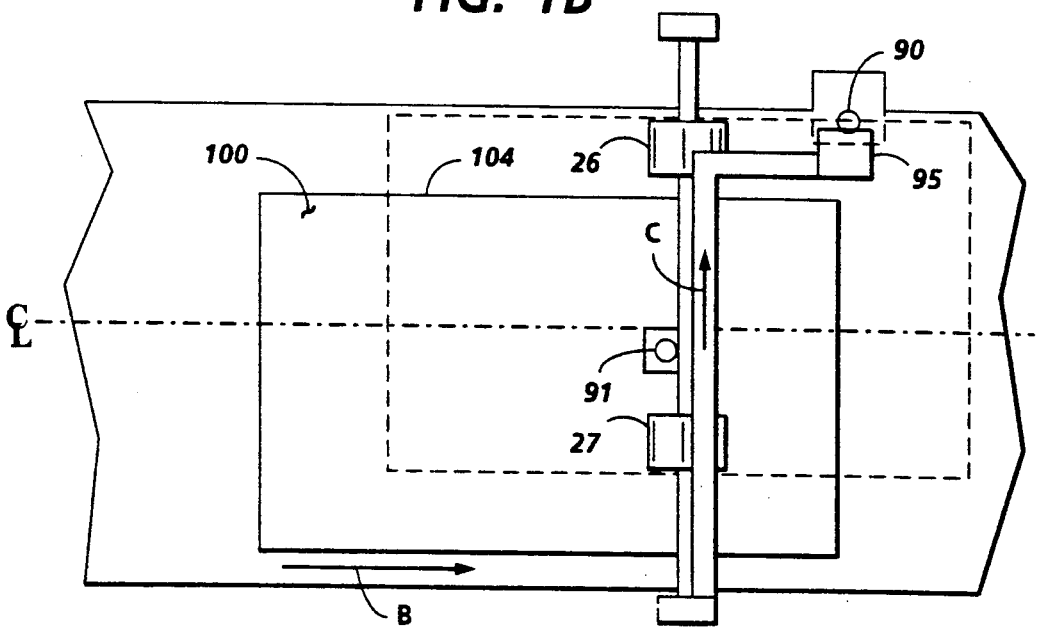

Referring now to FIG. 1B, it can be seen that a sensor 90 is located at the edge of the paper path in the proper registration position for the sheet edge. In the example shown in FIG. 1B, the translating roll pairs 25, 27 and 24, 26 are shifted in the direction of arrow C until the sheet edge 104 is recognized by the sensor 90. A stepper motor, (not shown), is utilized to drive the translating rolls in a lateral direction. A controller 115 (FIG. 2) counts the steps taken by the stepper motor until the sheet edge 104 is sensed by the sensor 90. In this manner, the translating registration and deskewing rolls 25, 27 and 24, 26 are always in a known position.

Figure 1C:
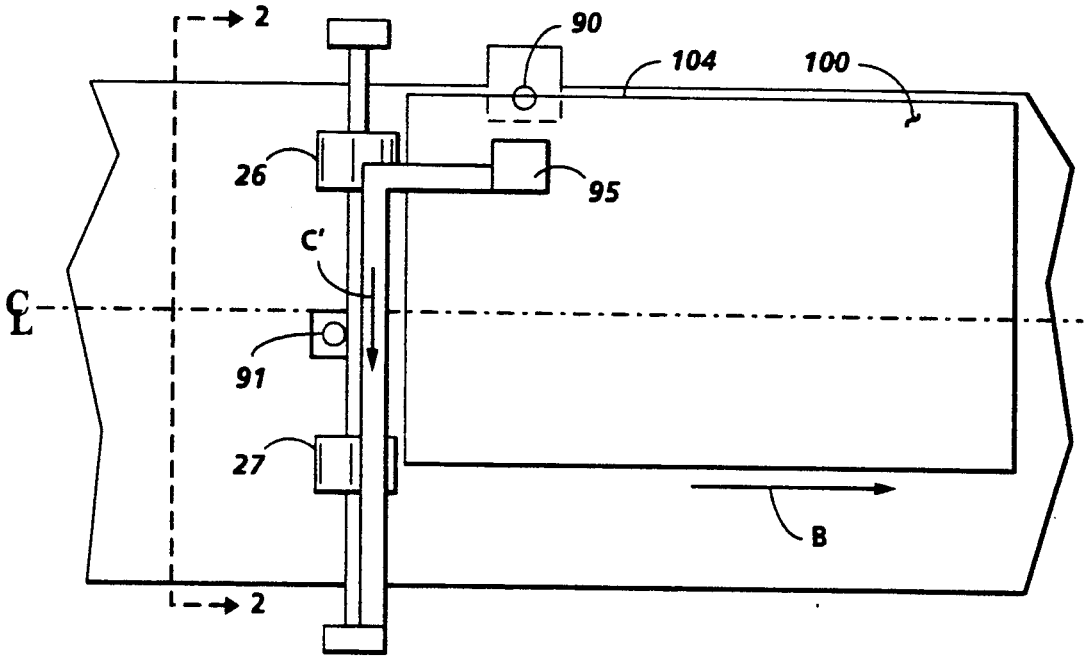

As can be seen in FIG. 1C, once the sheet 100 is in the proper registration position, it continues to be driven in the direction of arrow B to the next set of drive rolls (not shown). Registration and deskewing roll pairs 24, 26 and 25, 27 then return to the center line position by moving in the direction of arrow C′ to be ready to accept the next sheet. As a result of the stepper motor controller 115 (FIG. 2) counting the steps required to register the sheet, the controller reverses the stepper motor the same number of steps thereby placing the registration and deskewing rolls on the center line of the paper path for receipt of the next sheet.

In the event that the sheet 100 initially enters the registration and deskewing rolls 25, 27 and 24, 26 in a position which covers sensor 90, the stepper motor 110 is driven in the direction of arrow C′ until the sensor no longer senses the paper edge 104. The translating roll pairs 25, 27 and 24, 26 are then shifted in the direction of arrow C until the sheet edge 104 is recognized by the sensor 90. After the sheet 100 is forwarded along the paper path in direction of arrow B, the stepper motor 110 is again reversed from the direction required for registration the same number of steps required for registration thereby returning to the center line of the paper path. As a result of storing the step position of the centerline of the paper path and counting the steps required for registration, the translating roll pairs 25, 27 and 24, 26 are always in a known position.

Figure 2:
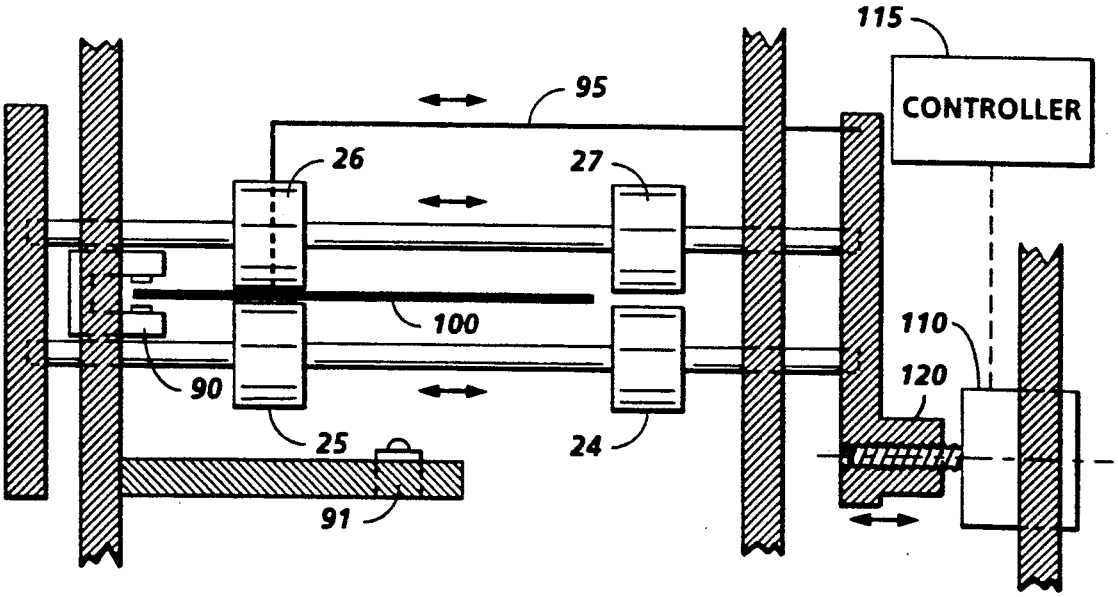
FIG. 2 is a side elevation taken along line A—A of FIG. 1C in the direction of the arrows.

Turning now to FIG. 2, there can be seen a cut-away elevational view taken along line A—A in the direction of the arrows in FIG. 1C. The relationship between the deskewing and registration roll pairs 25, 27 and 24, 26, the U-shaped paper edge sensor 90, the initialization flag 95, the registration stepper motor 110 and motor controller 115 can be seen. Item 120 represents a lateral drive mechanism which translates the rotary motion of the stepper motor 110 into lateral motion of the registration roll pairs 25, 27 and 24, 26.

Figure 3:
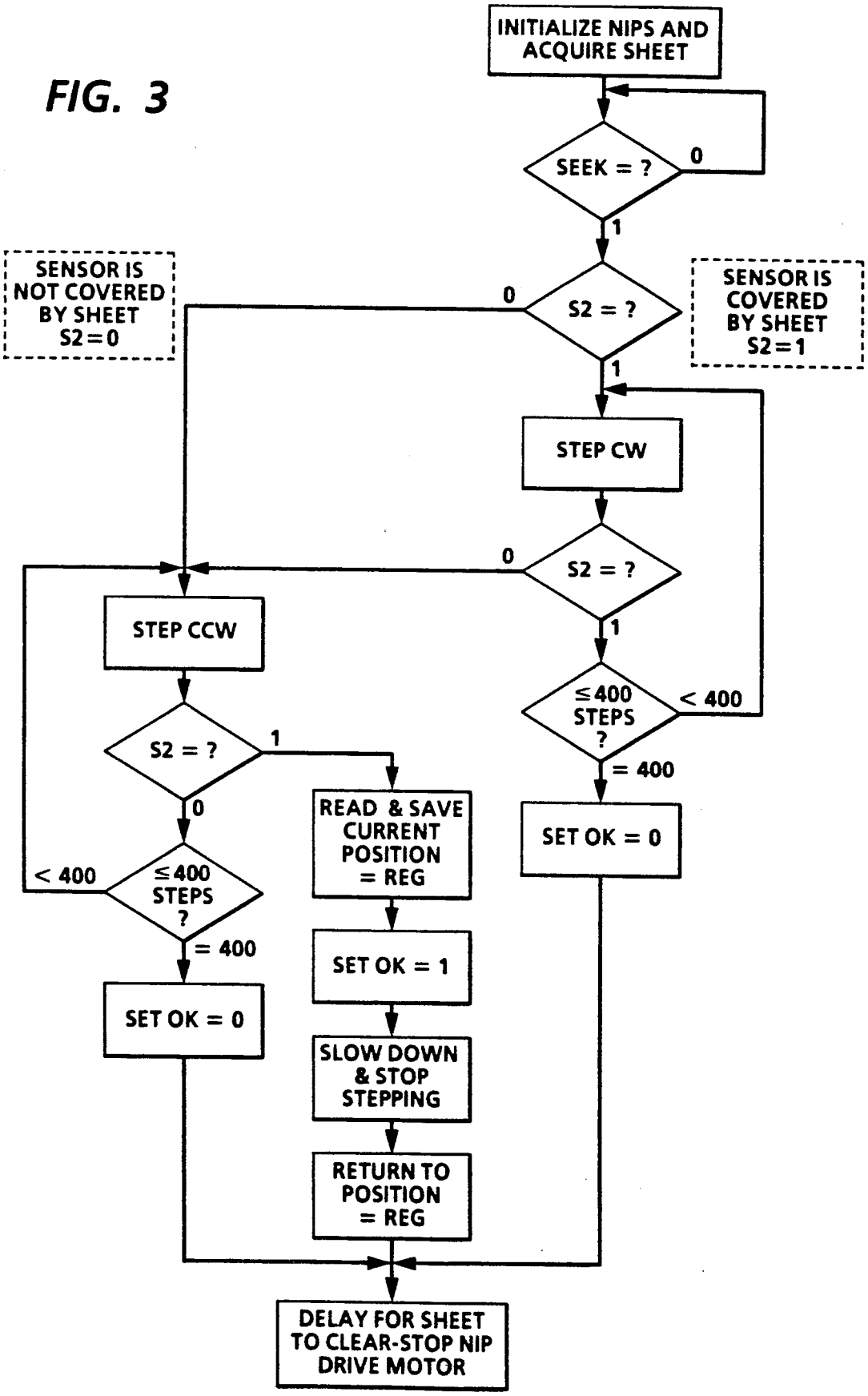
FIG. 3 is a flow diagram depicting the operation of the FIG. 1 apparatus.

With reference to FIG. 3, the operation of the translating nip can be described in greater detail. The flow diagram illustrates the steps utilized in the preferred embodiment of the present invention. The initialization flag 95 is first driven toward the sensor 90 until the sensor recognizes the flag 95. The registration roll pairs 25, 27 and 24, 26 (FIGS. 1A–2) are initialized in the approximate center of the paper path by counting a specified number of steps from a known position as indicated by the initialization flag 95 (FIGS. 1A–2) attached to the roll pairs 25, 27 and 24, 26 (FIGS. 1A–2) being sensed by the sensor 90. The nips then remain stopped until the sheet 100 is stalled and deskewed in the nips. Then, upon a signal from the acquisition sensor 91 which is sent, a predetermined time period after the sheet is driven into the stalled rolls, the nips are driven. Simultaneously, the seek signal is received from the machine controller again based upon the acquisition sensor signal which begins the registration cycle. The seek signal coincides with the signal to drive the rolls in the process direction.

If the sensor 90 (FIGS. 1A-2) is initially not covered by the sheet, the lateral stepper motor 110 is stepped counterclockwise until the sensor 90 is just covered and that position is saved as the registration position by the step motor controller 115. The stepper motor 110 (FIG. 2), due to the high speed of registration, cannot immediately stop at the registration point, but instead overruns slightly and then returns to the registration point. This is accomplished by storing the stepper motor count at the point which trips the sensor 90. The motor 110 is reversed to that specific count position to register the sheet. If the sensor 90 (FIGS. 1A-2) is initially covered by the sheet, the motor 110 is stepped clockwise until the sensor 90 is no longer covered and then the above counterclockwise procedure is repeated until registration is complete. This entire registration procedure occurs within the period the sheet is being driven in the paper path direction by the nips. Once the sheet is registered and driven out of the nips, the nips are returned to the step count determined at initialization which coincides with the center of the paper path and stopped to await the next sheet. It is noted that the position of the initialization flag 95 is such that it does not interfere with the sheet registration movement.

The 400 step limitation illustrated in FIG. 3 is the mechanical limitation of the preferred embodiment set up for $8\frac{1}{2}\times 11$ sheets. The 400 steps in the preferred embodiment is equivalent to six millimeters (6 mm) of lateral movement and could be accomplished within seven inches of sheet displacement in the process direction. Different parameters can be programmed for other sized sheets. Likewise different lateral drive mechanisms may be used to allow greater or less lateral adjustment.

The deskewing and registration device 22 of the present invention may also be used in a document handler, generally indicated by the reference numeral 19, as seen in FIG. 4.

In recapitulation, there is provided a bilateral registration and deskewing device. The rolls of the deskewing device are initially stopped in the center of the paper path and the leading edge of the sheet is driven into the nips of the stalled rolls to align the sheet. The sheet is then driven along the paper path by the rolls while at the same time the entire roll set is laterally driven by a stepper motor until a sensor in the proper position in the paper path senses the sheet side edge. A counter records the number of steps required to register the sheet edge. When the position sensor senses the sheet edge, the position is stored and the sheet is then brought to the registration position by the stepper motor controller. The sheet then is driven along the paper path in the proper lateral position. The deskewing and registration rolls are then driven in the reverse lateral direction the same number of steps as was required to register the sheet so as to return to the centerline of the paper path to accept the next sheet. Accordingly, there is no need to trip a position sensor switch or to return to a "home" position between each sheet. Additionally, the device is adapted to register a sheet which is received misaligned in either lateral direction and return to the center of the paper path between each sheet.

It is, therefore, apparent that there has been provided in accordance with the present invention, a deskewing and lateral registration apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for advancing a sheet in a primary sheet feeding direction and for deskewing and side registering the sheet, comprising:

means, located in a home position, for advancing the sheet in the primary sheet feeding direction, deskewing the sheet and translating the sheet in a direction substantially transverse to the primary sheet feeding direction;

means for sensing the sheet, said advancing and translating means moving in unison with the deskewed sheet in a direction substantially transverse to the primary sheet feeding direction from the home position to a side registration postion, said sensing means detecting the sheet in the side registration position; and means for storing the registration position.

2. The apparatus according to claim 1, wherein said advancing means returns to the home position from the side registration position in response to said sensing means detecting the sheet.

3. The apparatus according to claim 2, wherein said advancing means comprises:

a roll pair defining a drive nip; and means for translating said roll pair in a direction substantially parallel to the axis of rotation of a roll of said roll pair.

4. The apparatus according to claim 3, wherein said translating means moves said roll pair in response to a signal from said sensing means.

5. The apparatus according to claim 4, wherein said translating means comprises a stepper motor.

6. An apparatus according to claim 1, wherein said sensing means comprises an optical sensor.

7. The apparatus according to claim 2, further comprises means, responsive to a signal from said sensing means, for storing the home position of said advancing means and returning said advancing means to said stored home position after each sheet exits said advancing means.

8. An apparatus for advancing a sheet in a primary sheet feeding direction and for deskewing and side registering the sheet, comprising:

means, located in a home position, for advancing the sheet in the primary sheet feeding direction and deskewing the sheet including a roll pair defining a drive nip, and means for translating said roll pair in a direction substantially parallel to the axis of rotation of a roll of said roll pair; and means for sensing the sheet, said advancing means moving in unison with the deskewed sheet in a direction substantially transverse to the primary sheet feeding direction from the home position to a side registration position, said sensing means detecting the sheet in the side registration position, wherein said translating means moves said roll pair in response to a signal from said sensing means and wherein said translating means further comprises a stepper motor, means for counting the steps of the stepper motor, and means for storing a particular count responsive to a signal from said sensing means.

9. An apparatus for advancing a sheet in a primary sheet feeding direction and for deskewing and side registering the sheet, comprising:

means, located in a home position, for advancing the sheet in the primary sheet feeding direction and deskewing the sheet;

means for sensing the sheet, said advancing means moving in unison with the deskewed sheet in a direction substantially transverse to the primary sheet feeding direction from the home position to a side registration position, said sensing means detecting the sheet in the side registration position wherein said advancing means returns to the home position from the side registration position in response to said sensing means detecting the sheet; and means, responsive to a signal from said sensing means, for storing the side registration position of said advancing means and returning said advancing means to said stored side registration position when said advancing means moves, from the home position to a position spaced from the side registration position wherein said advancing means returns to the home position from the side registration position in response to said sensing means detecting the sheet.

10. An electrophotographic printing machine of the type in which a sheet is advanced in a primary sheet feeding direction and is deskewed and side registered, wherein the improvement comprises:

means, located in a home position, for advancing the sheet in the primary sheet feeding direction, deskewing the sheet and translating the sheet in a direction substantially transverse to the primary sheet feeding direction;

means for sensing the sheet, said advancing and translating means moving in unison with the deskewed sheet in a direction substantially transverse to the primary sheet feeding direction from the home position to a side registration position, said sensing means detecting the sheet in the side registration position; and means for storing the registration position.

11. The printing machine according to claim 10, wherein said advancing means returns to the home position from the side registration position in response to said sensing means detecting the sheet.

12. The printing machine according to claim 11, wherein said advancing means comprises:

a roll pair defining a drive nip; and means for translating said roll pair in a direction substantially parallel to the axis of rotation of a roll of said roll pair.

13. The printing machine according to claim 12, wherein said translating means moves said roll pair in response to a signal from said sensing means.

14. The printing machine according to claim 13, wherein said translating means comprises a stepper motor.

15. A printing machine according to claim 10, wherein said sensing means comprises an optical sensor.

16. The printing machine of claim 10, wherein the sheet being advanced is a copy sheet.

17. The printing machine of claim 10, wherein the sheet being advanced is an original document.

18. An electrophotographic printing machine of the type in which a sheet is advanced in a primary sheet feeding direction and is deskewed and side registered, wherein the improvement comprises:

means, located in a home position, for advancing the sheet in the primary sheet feeding direction and deskewing the sheet including a roll pair defining a drive nip, and means for translating said roll pair in a direction substantially parallel to the axis of rotation of a roll of said roll pair; and means for sensing the sheet, said advancing means moving in unison with the deskewed sheet in a direction substantially transverse to the primary sheet feeding direction from the home position to a side registration position, said sensing means detecting the sheet in the side registration position, wheren said translating means moves said roll pair in response to a signal from said sensing means and wherein said translating means further comprises a stepper motor, means for counting the steps of the stepper motor, and means for storing a particular count responsive to a signal from said sensing means.

19. The printing machine according to claim 18, further comprises means, responsive to a signal from said sensing means, for storing the home position of said advancing means and returning said advancing means to said stored home position after each sheet exits said advancing means.

20. The printing machine according to claim 18, further comprises means, responsive to a signal from said sensing means, for storing the side registration position of said advancing means and returning said advancing means to said stored side registration position when said advancing means moves, from the home position to a position spaced from the side registration position.

21. A method for deskewing and side registering a sheet in an electrophotographic printing machine comprising the steps of:

advancing the sheet in the primary sheet feed direction until a portion of the sheet engages a non-operative roll pair so as to deskew the sheet;

actuating the roll pair after deskewing the sheet to advance the sheet in the primary sheet feed direction;

moving the roll pair in unison with the advancing sheet in a direction transverse to the primary sheet feed direction from a home position to a side registration position; and sensing the presence of the sheet in the side registration position; and storing the registration position.

22. The method of claim 21, further comprising storing the home position of said roll pair and returning said roll pair to the stored home position after each sheet exits roll pair.

23. A method for deskewing and side registering a sheet in an electrophotographic printing machine comprising the steps of:

advancing the sheet in the primary sheet feed direction until a portion of the sheet engages a non-operative roll pair so as to deskew the sheet;

actuating the roll pair after deskewing the sheet to advance the sheet in the primary sheet feed direction;

moving the roll pair in unison with the advancing sheet in a direction transverse to the primary sheet feed direction from a home position to a side registration position;

sensing the presence of the sheet in the side registration position;

storing the home position of said roll pair and returning said roll pair to the stored home position after each sheet exits roll pair; and storing the sensed proper side registration position of said roll pair and returning said roll pair to the stored side registration position when said roll pair moves, from the home position to a position spaced from the side registration position.

* * * * *